US010883396B1

(12) United States Patent
de Oliveira Ghiraldi et al.

(10) Patent No.: US 10,883,396 B1
(45) Date of Patent: Jan. 5, 2021

(54) CAMSHAFT PHASER WITH RESILIENT COVER PLATE

(71) Applicant: Schaeffler Technologies AG & Co. KG, Herzogenaurach (DE)

(72) Inventors: Renato de Oliveira Ghiraldi, Madison Heights, MI (US); Alexandre Camilo, Rochester Hills, MI (US)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 0 days.

(21) Appl. No.: 16/546,699

(22) Filed: Aug. 21, 2019

(51) Int. Cl.
*F01L 1/344* (2006.01)

(52) U.S. Cl.
CPC ... *F01L 1/3442* (2013.01); *F01L 2001/34479* (2013.01); *F01L 2001/34483* (2013.01)

(58) Field of Classification Search
CPC ..... F01L 1/3442; F01L 2001/34479; F01L 2001/34483
USPC ..... 123/90.15, 90.17
See application file for complete search history.

(56) References Cited

U.S. PATENT DOCUMENTS 5,040,651 A 8/1991 Hampton et al.
2011/0073055 A1* 3/2011 Kobayashi ..... F01L 1/3442 123/90.17
2011/0120399 A1* 5/2011 Weber ..... F01L 1/022 123/90.15
2013/0000578 A1* 1/2013 Cole ..... F01L 1/3442 123/90.17
2013/0199469 A1* 8/2013 Busse ..... F01L 1/3442 123/90.15
2013/0199471 A1* 8/2013 Schafer ..... F01L 1/3442 123/90.15
2015/0211391 A1* 7/2015 Bayrakdar ..... F01L 1/34409 123/90.15
2018/0106167 A1* 4/2018 Camilo ..... F01L 1/3442
2018/0142584 A1* 5/2018 Becker ..... F01L 1/3442
2018/0355767 A1* 12/2018 Boese ..... F01L 1/352

* cited by examiner

*Primary Examiner* — Jorge L Leon, Jr.

(57) ABSTRACT

A hydraulic camshaft phaser including: a stator including a surface facing radially outwardly, and defining a recess; a rotor arranged to be non-rotatably connected to a camshaft and rotatable with respect to the stator; a spiral spring disposed in the recess and including a first end non-rotatably connected to the rotor and a second end non-rotatably connected to the stator; and a resilient cover plate directly connected to the surface facing radially outwardly, enclosing the spiral spring in the recess, and circumferentially pre-loaded. A hydraulic camshaft phaser including: a stator: arranged to receive rotational torque and defining a recess and a groove; a rotor rotatable with respect to the stator; a spiral spring disposed in the recess; and a resilient cover plate including a portion disposed in the groove, enclosing the spiral spring in the recess, and compressively engaging the stator in a radially inward direction.

20 Claims, 7 Drawing Sheets

CAMSHAFT PHASER WITH RESILIENT COVER PLATE

TECHNICAL FIELD

The present disclosure relates to a hydraulic camshaft phaser with a resilient cover plate for enclosing a spiral bias spring for the camshaft phaser.

BACKGROUND

For a known hydraulic camshaft phaser, it is known to use nail head pins (pins with expanded distal ends) and nail head bolts (bolts with expanded distal ends) in addition to standard bolts and pins (neither having expanded distal ends) to assemble the camshaft phaser, secure a spiral bias spring to a stator, and axially retain the spiral bias spring. The use of nail head pins and bolts with nail head ends increases a parts count for the camshaft phaser and entails the use of further operations after initial insertion of the nail head pins and bolts with nail head ends.

SUMMARY

According to aspects illustrated herein, there is provided a hydraulic camshaft phaser, including: a stator arranged to receive rotational torque, including a surface facing radially outwardly, and defining a recess; a rotor rotatable with respect to the stator and arranged to be non-rotatably connected to a camshaft; a spiral spring disposed in the recess and including a first end non-rotatably connected to the rotor and a second end non-rotatably connected to the stator; and a resilient cover plate directly connected to the surface facing radially outwardly, enclosing the spiral spring in the recess, and circumferentially preloaded.

According to aspects illustrated herein, there is provided a hydraulic camshaft phaser, including: a stator: arranged to receive rotational torque and defining a recess and a groove; a rotor arranged to be non-rotatably connected to a camshaft and rotatable with respect to the stator; a spiral spring disposed in the recess; and a resilient cover plate including a portion disposed in the groove, enclosing the spiral spring in the recess, and compressively engaging the stator in a radially inward direction.

According to aspects illustrated herein, there is provided a hydraulic camshaft phaser, including: a stator arranged to receive rotational torque and defining a recess and a groove; a rotor arranged to be non-rotatably connected to a camshaft and rotatable with respect to the stator; a spiral spring disposed in the recess and including a first end non-rotatably connected to the rotor and a second end non-rotatably connected to the stator; and a resilient cover plate including a radially innermost surface disposed in the groove, a first end facing in a first circumferential direction, and a second end facing the first end in a second circumferential direction, opposite the first circumferential direction, the first end and the second end bounding a gap in the first circumferential direction. A spring force of the resilient cover plate urges the radially innermost surface into contact with the stator and the first end and the second end toward each other. The spiral spring is located between the stator and the resilient cover plate.

BRIEF DESCRIPTION OF THE DRAWINGS

Various embodiments are disclosed, by way of example only, with reference to the accompanying schematic drawings in which corresponding reference symbols indicate corresponding parts, in which.

DETAILED DESCRIPTION

At the outset, it should be appreciated that like drawing numbers on different drawing views identify identical, or functionally similar, structural elements of the disclosure. It is to be understood that the disclosure as claimed is not limited to the disclosed aspects.

Furthermore, it is understood that this disclosure is not limited to the particular methodology, materials and modifications described and as such may, of course, vary. It is also understood that the terminology used herein is for the purpose of describing particular aspects only, and is not intended to limit the scope of the present disclosure.

Unless defined otherwise, all technical and scientific terms used herein have the same meaning as commonly understood to one of ordinary skill in the art to which this disclosure belongs. It should be understood that any methods, devices or materials similar or equivalent to those described herein can be used in the practice or testing of the disclosure.

Figure 1:
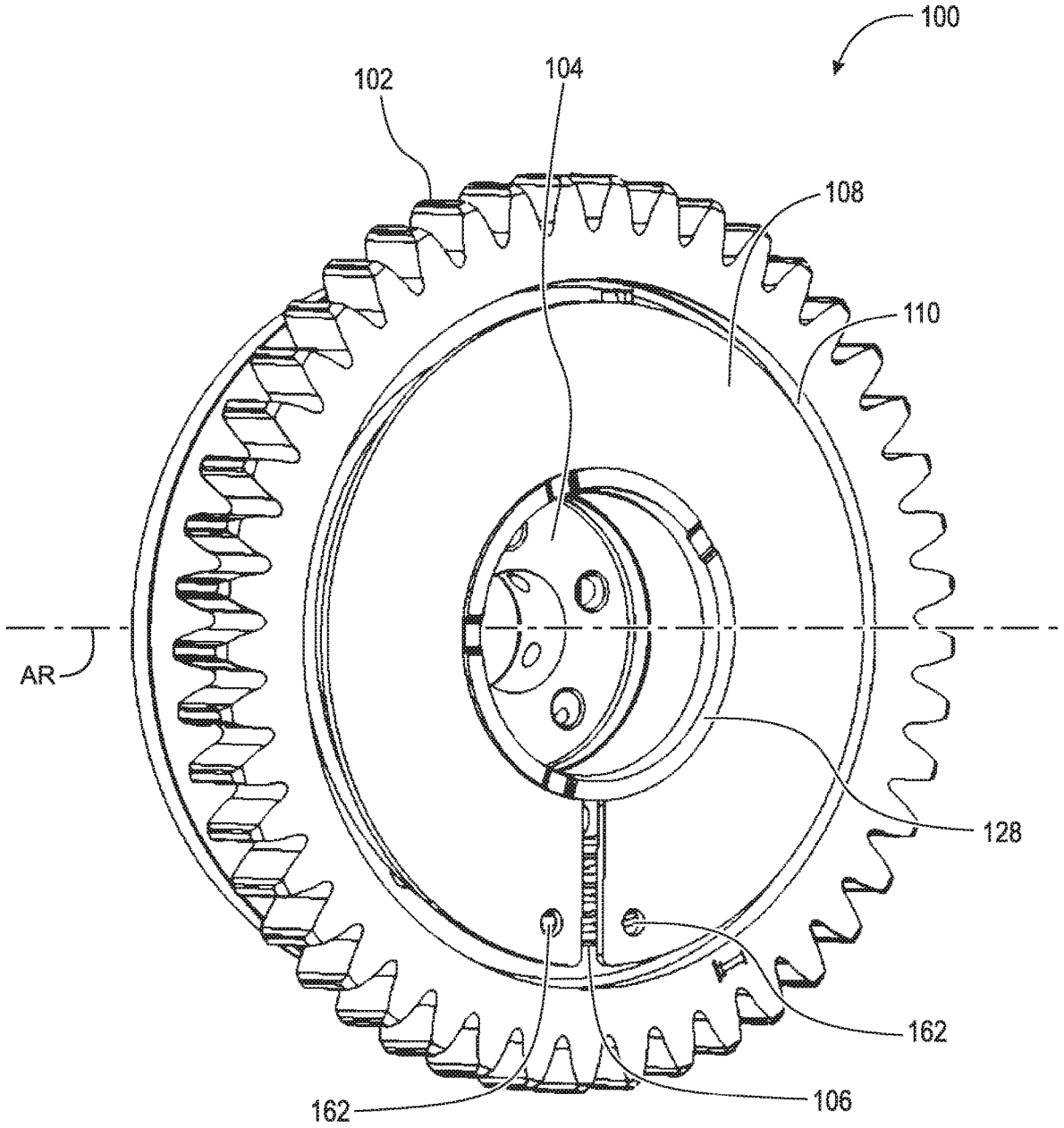
FIG. 1 is a front isometric view of a camshaft phaser with a resilient cover plate.

FIG. 1 is a front isometric view of camshaft phaser 100 with a resilient cover plate.

Figure 2:
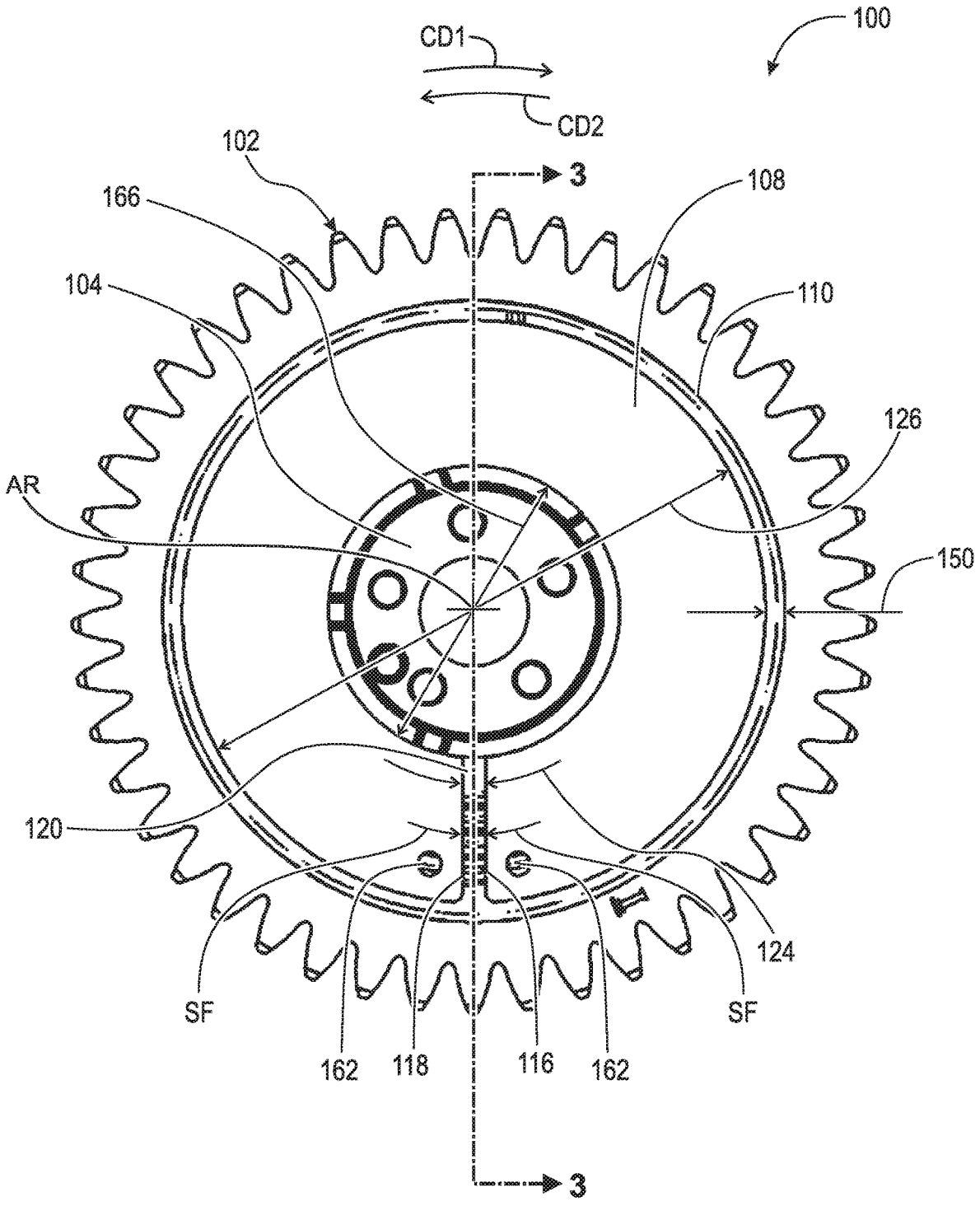
FIG. 2 is a front view of the camshaft phaser shown in FIG. 1.

FIG. 2 is a front view of camshaft phaser 100 shown in FIG. 1.

Figure 3:
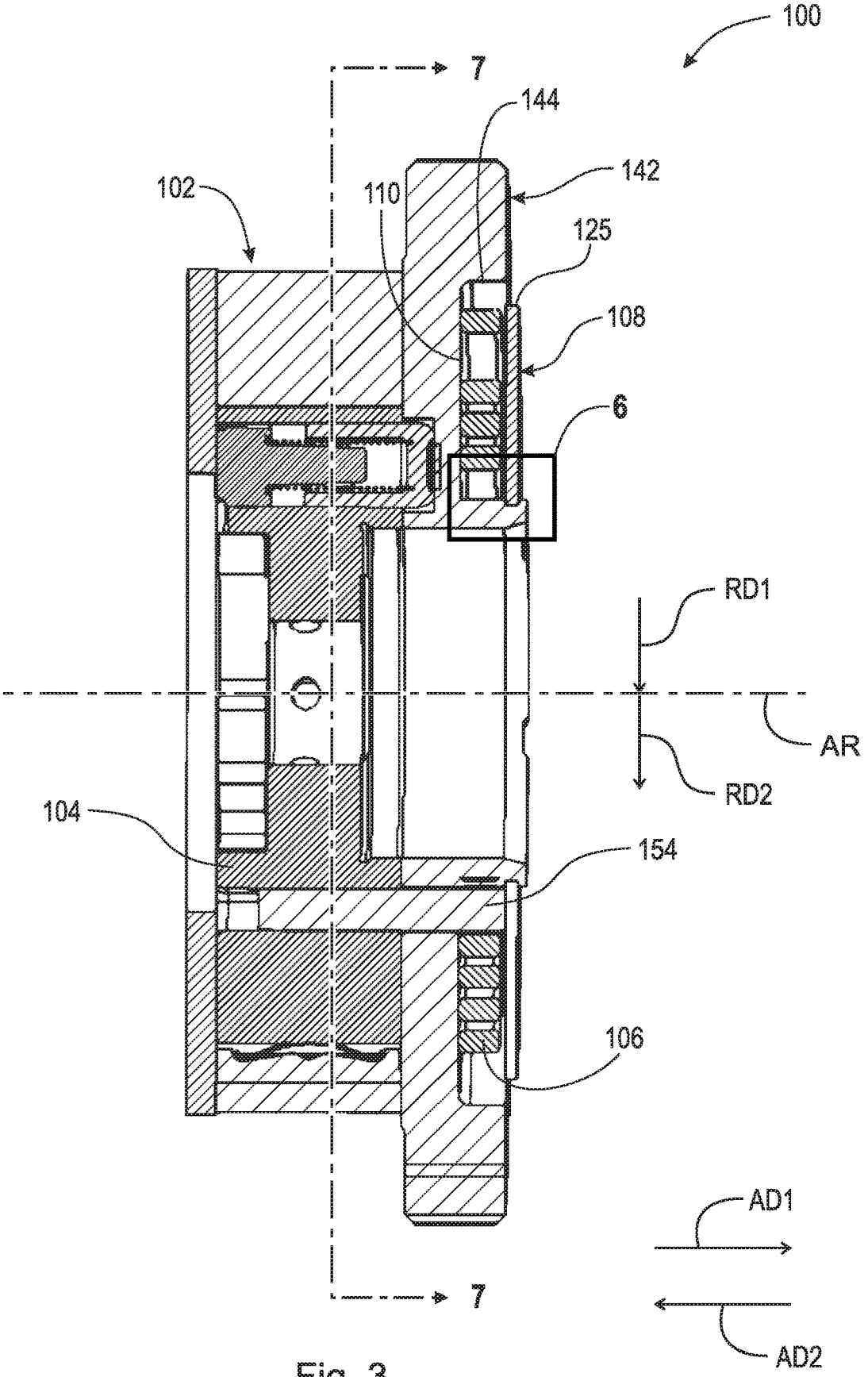
FIG. 3 is a cross-section generally along line 3-3 in FIG. 2.

FIG. 3 is a cross-section generally along line 3-3 in FIG. 2.

Figure 4:
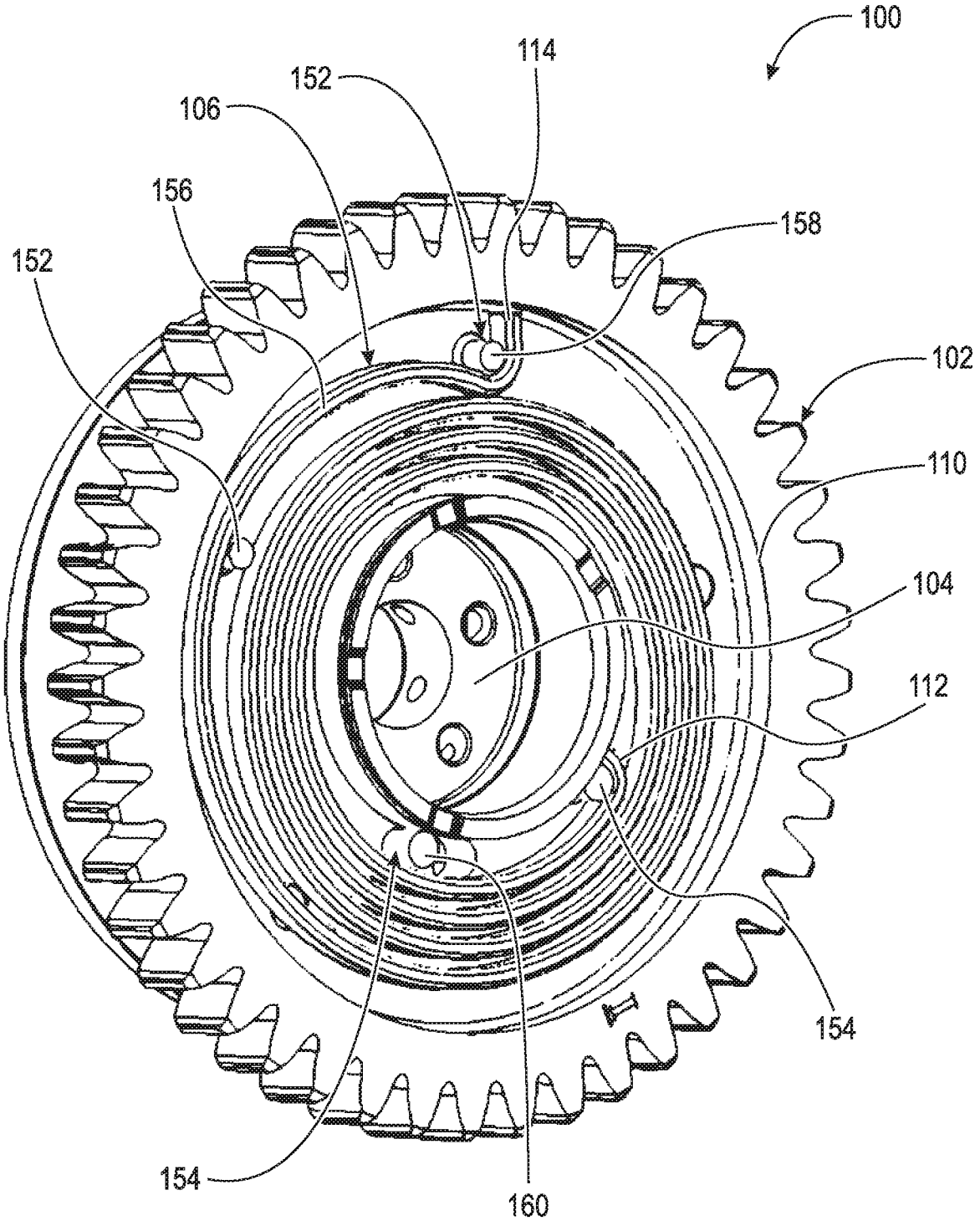
FIG. 4 is a front isometric view of the camshaft phaser shown in FIG. 1 with the resilient cover plate removed.

FIG. 4 is a front isometric view of camshaft phaser 100 shown in FIG. 1 with the resilient cover plate removed. The following should be viewed in light of FIGS. 1 through 4. Hydraulic camshaft phaser 100 includes: stator 102; rotor 104; spiral bias spring 106; and resilient cover plate 108. Stator 102 is arranged to receive rotational torque and defines recess 110. Rotor 104 is rotatable with respect to stator 102 and is arranged to be non-rotatably connected to a camshaft (not shown). Spiral spring 106 is disposed in recess 110; is located between stator 102 and resilient cover plate 108 in axial direction AD1; and includes end 112 non-rotatably connected to rotor 104, end 114 non-rotatably connected to stator 102. Phaser 100 is supported for rotation around axis of rotation AR and direction AD1 is parallel to axis AR.

By "non-rotatably connected" components, we mean that components are connected so that whenever one of the components rotates, all the components rotate; and relative rotation between the components is precluded. Radial and/or axial movement of non-rotatably connected components with respect to each other is possible. Components connected by tabs, gears, teeth, or splines are considered as non-rotatably connected despite possible lash inherent in the connection. The input and output elements of a closed clutch are considered non-rotatably connected despite possible slip in the clutch. The input and output parts of a vibration damper, engaged with springs for the vibration damper, are not considered non-rotatably connected due to the compression and unwinding of the springs.

Figure 5:
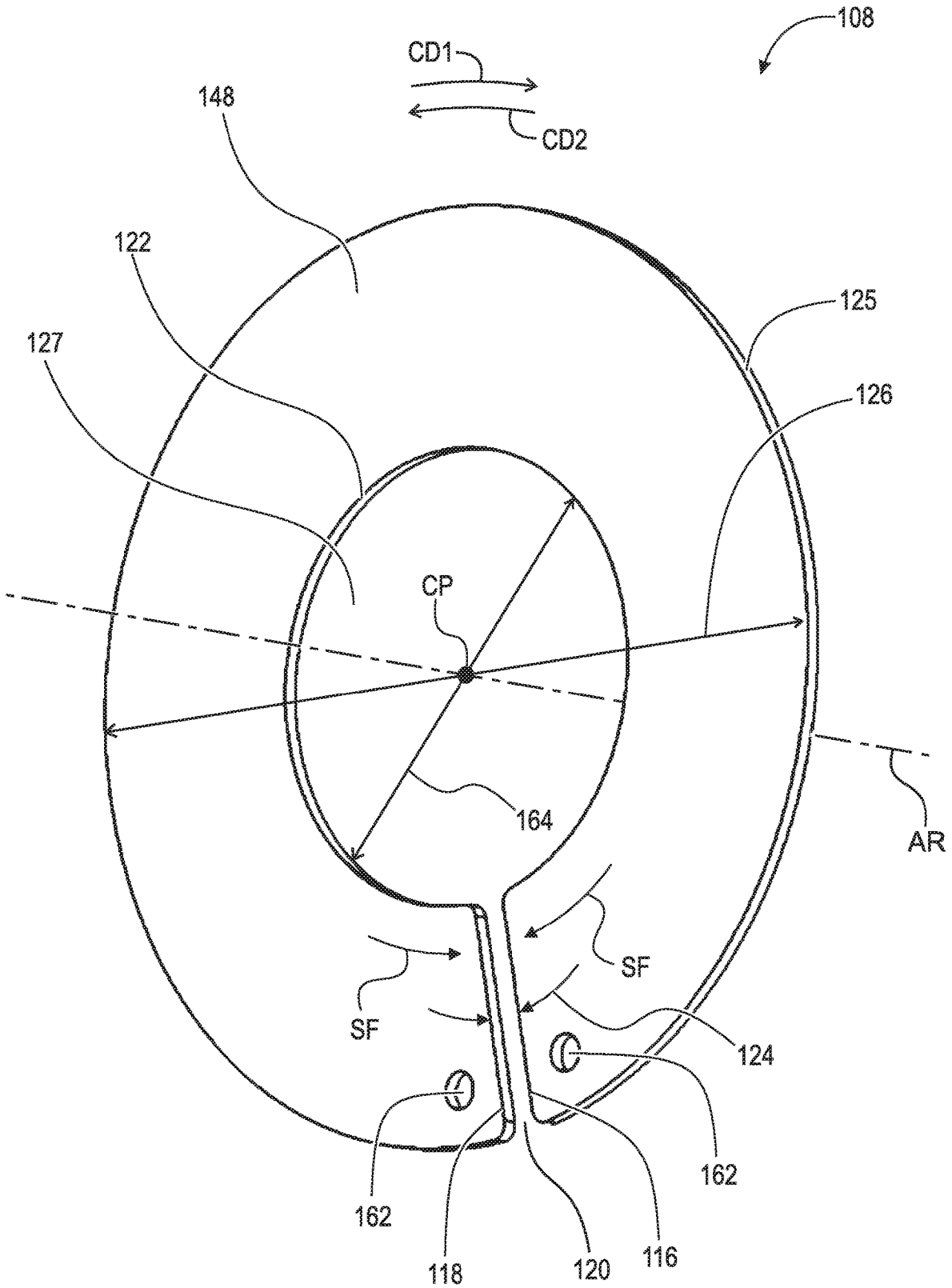
FIG. 5 is a front isometric view of the resilient cover plate shown in FIG. 1.

FIG. 5 is a front isometric view of resilient cover plate 108 shown in FIG. 1. The following should be viewed in light of FIGS. 1 through 5. In FIG. 5, cover plate 108 is in a free, free-standing, or unengaged state. That is, cover plate 108 is not engaged with another element, such as stator 102. In FIG. 1, resilient cover plate 108: is directly connected to stator 102; and encloses spiral spring 106 in recess 110. Resilient cover plate 108 includes circumferential end 116 and circumferential end 118 and defines gap 120 between ends 116 and 118 in direction CD1 and CD2. Plate 108 is discontinuous at gap 120. Resilient cover plate 108 is circumferentially preloaded. Stator 102 blocks displacement of resilient cover plate 108 in at least one of axial direction AD1 and axial direction AD2, opposite direction AD1. In an example embodiment, stator 102 blocks displacement of cover plate 108 in direction AD1 and in direction AD2. Resilient cover plate 108 axially retains spring 106. For example, resilient cover plate 108 blocks displacement of spring 106 in direction AD1.

Plate 108 includes radially inner surface 122. Ends 116 and 118 are separated in directions CD1 and CD2 by circumferential dimension 124. Plate 108 includes radially outer surface 125 and outside radial distance, or outside diameter, 126, measured at surface 125.

By "circumferentially preloaded" we mean that in the rest position shown in FIG. 5, spring force SF resists: displacement of end 116 and end 118 in circumferential direction CD2 and circumferential direction CD1, respectively; an increase of circumferential dimension 124 in directions CD1 and CD2; displacement of surface 122 in radially outer direction RD1; and an increase of outside radial distance, or outside diameter, 126. In FIG. 1, spring force SF: urges ends 116 and 118 toward each other in directions CD1 and CD2, respectively; and urges radially inner surface 122, radially inwardly in radial direction RD1. Thus, In FIG. 1: dimension 124 and distance 126 are larger than in FIG. 5. Inner surface 122 defines central opening 127 through which axis of rotation AR passes.

Figure 6:
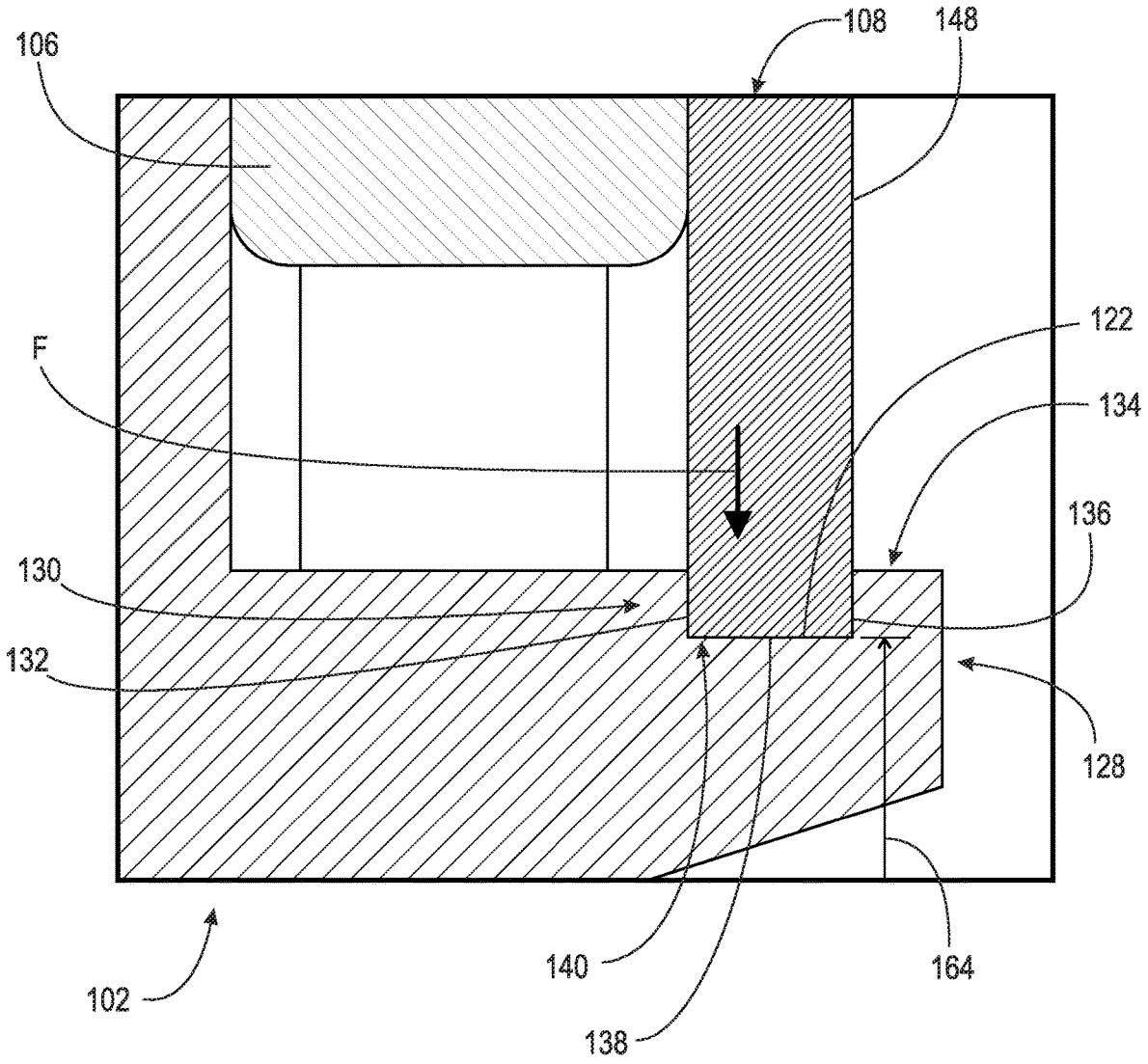
FIG. 6 is a detail of area 6 in FIG. 3.

FIG. 6 is a detail of area 6 in FIG. 3. The following should be viewed in light of FIGS. 1 through 6. Stator 102 includes radially innermost portion 128. Portion 128 includes: shoulder 130 with radial surface 132 facing in direction AD1; lip 134 with radial surface 136 facing in direction AD2; and circumferential surface 138 facing radially outwardly in direction RD2 and connecting shoulder 130 and lip 134. Shoulder 130, in particular surface 132, lip 134, in particular surface 136, and surface 138 define circumferentially disposed groove 140. Thus, surfaces 132 and 136 bound groove 140 in directions AD1 and AD2, respectively. In an example embodiment, groove 140 is continuous in directions CD1 and CD2. Due to spring force SF, radially innermost surface 122 is in compressive contact with stator 102, for example in compressive contact with surface 138. Thus, resilient cover plate 108 is directly connected to surface 138. Thus, surface 122 is in compressive contact with surface 138 and exerts force F on surface 138 in direction RD1.

Stator 102 includes radially outermost portion 142 with circumferential surface 144 facing radially inwardly in radial direction RD1. Radially outermost circumferential surface 125 of plate 108 is free of contact with surface 144. In an example embodiment, radial surface 148 of plate 108, facing in axial direction AD1, is off-set from portion 142 in direction AD1. That is, at least a portion of cover plate 108 does not overlap portion 142 in direction RD2. Note that in FIG. 5, distance 126 passes through center point CP of cover plate 108 and is measured from surface 12. In FIG. 2, distance 126 passes through axis of rotation AR. Surface 144 and surface 2 bound gap 150, in radial direction RD2. Portion 128 of stator 102 extends past cover plate 108 in direction AD1.

Shoulder 130, in particular surface 132, and lip 134, in particular surface 136, block displacement of resilient cover plate 108 in directions AD2 and AD, respectively. In an example embodiment, resilient cover plate 108 is in contact with one or both of shoulder 130, in particular surface 132, and lip 134, in particular surface 136. In an example embodiment, resilient cover plate 108 is in contact with both shoulder 130, in particular surface 132, and lip 134, in particular surface 136, and is axially fixed, with respect to stator 102, within groove 140.

Phaser 100 includes standard long bolts 152 and standard needles 154 used to restrain and guide spring 106 radially and circumferentially. In an example embodiment, bolts 152 and needles 154 do not overlap surface 156 of spring 106, facing in direction AD1, in direction AD1. That is, bolts 152 and needles 154 do not extend past surface 156 in direction AD1. For example: distal ends 158 of bolts 152, facing in direction AD1, do not overlap or extend past surface 156 in direction AD; and distal ends 160 of needles 154, facing in direction AD1, do not overlap or extend past surface 156 in direction AD1. In the example of FIG. 1, one bolt 152 secures end 114 of spring 106 to stator 102 and one needle 154 secures end 112 of spring 106 to rotor 104.

In an example embodiment, resilient cover plate 108 includes openings 162 used to install and remove resilient cover plate 108 from phaser 100. For example, in the at rest configuration of FIG. 5, inside radial distance, or inside diameter, 164 of cover plate 108 is less than outside diameter 166 of portion 128. In FIG. 5, distance 164 is measured from surface 122 through center point CP of cover plate 108. In FIG. 2, distance 164 is measured through axis of rotation AR. To install resilient cover plate 108 in groove 140 a tool (not shown) is engaged with openings 162 to expand gap 120 and increase dimension 124 (displace ends 116 and 118 away from each other), which in turn increases distance 164 to be greater than diameter 166, enabling resilient cover plate 108 to slide over lip 134 and radially align, or overlap, with groove 140. The tool is then disengaged so that spring force SF displaces ends 116 and 118 toward each other, contracting resilient cover plate 108 radially inwardly to reduce gap 120 and distances 126 and 164, and bring surface 122 into compressive engagement with portion 128, in particular surface 138. To remove resilient cover plate 108 from groove 140 the tool is engaged with openings 162 to expand gap 120 and increase dimension 124.

Figure 7:
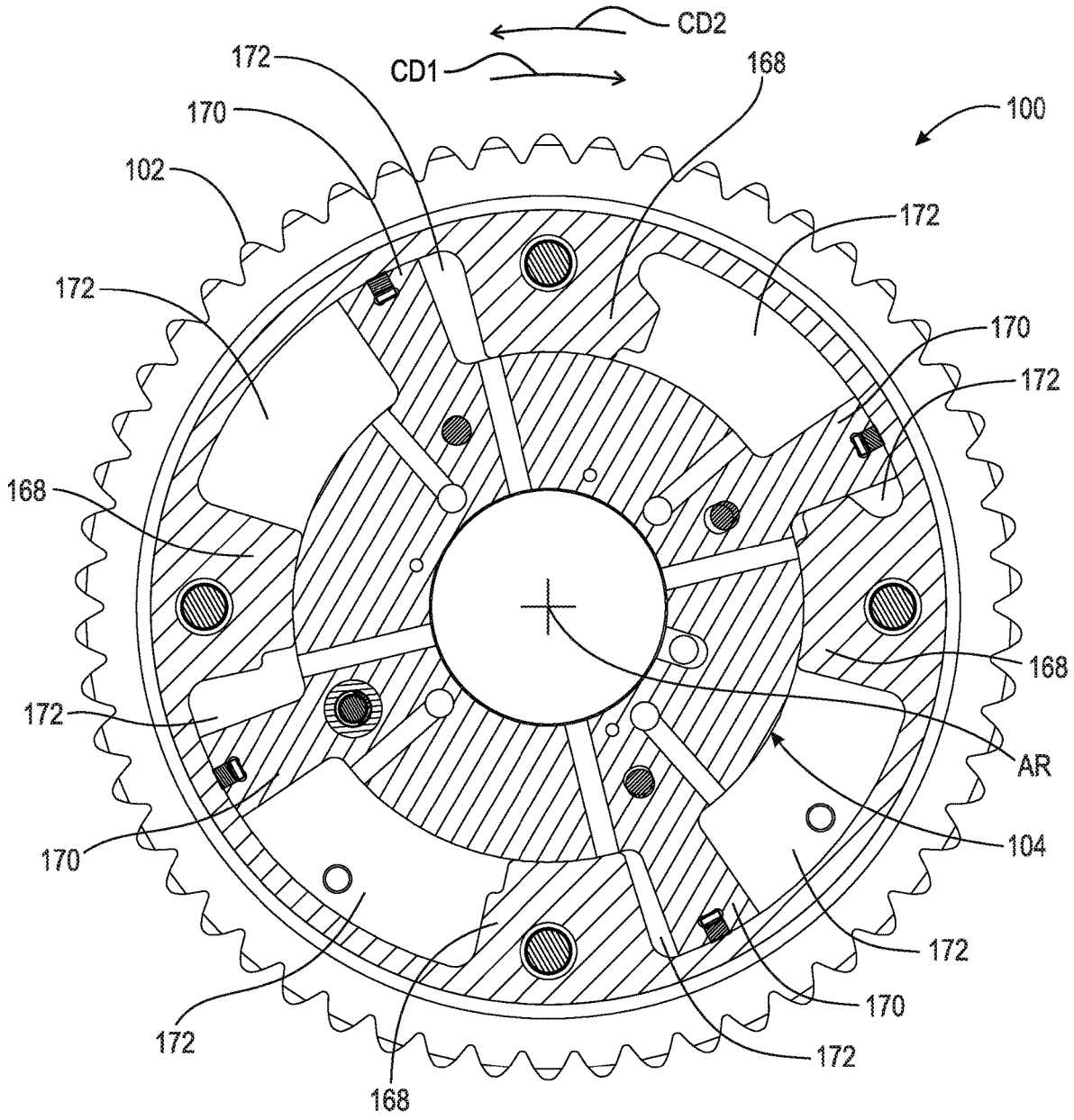
FIG. 7 is a cross-sectional view generally along line 7-7 in FIG. 3.

FIG. 7 is a cross-sectional view generally along line 7-7 in FIG. 3. The following should be viewed in light of FIGS. 1 through 7. Stator 102 includes radially inwardly extending protrusions 168 and rotor 104 includes radially outwardly extending protrusions 170 circumferentially interleaved with protrusions 168. Phaser 100 includes chambers 172 at least partially defined by protrusions 168 and protrusions 170. As is known in the art, pressurized fluid (not shown) is pumped into and drained out of chambers 172 to shift a rotational position of rotor 104 with respect to stator 102.

Resilient cover plate 108 eliminates the need for nail head pins and nail head bolts to secure spiral spring 106 to stator 102 and rotor 104, which reduces the number of operations associated with securing spring 106 to stator 102 and rotor 104. Further, standard long bolts 152 and standard needles

154 are used in phaser 100 in all places requiring a long bolt or needle. Thus, only one type of bolt 152, is needed for assembling phaser 100, and needles 154 can be pressed on in a secondary operation. Therefore, for camshaft phaser 100: the parts count is reduced and simplified; fabrication and assembly steps are simplified; and costs are reduced.

It will be appreciated that various of the above-disclosed and other features and functions, or alternatives thereof, may be desirably combined into many other different systems or applications. Various presently unforeseen or unanticipated alternatives, modifications, variations, or improvements therein may be subsequently made by those skilled in the art which are also intended to be encompassed by the following claims.

LIST OF REFERENCE CHARACTERS

AD1 axial direction
AD2 axial direction
AR axis of rotation
CD1 circumferential direction
CD2 circumferential direction
F force
RD1 radially inner direction
RD2 radially outer direction
SF spring force
100 hydraulic camshaft phaser
102 stator
104 rotor
106 coil spring
108 resilient cover plate
110 recess
112 end coil spring
114 end coil spring
116 end, resilient cover plate
118 end, resilient cover plate
120 gap, resilient cover plate
122 radially inner surface, resilient cover plate
124 circumferential distance
125 radially outer surface, resilient cover plate
126 outside radial distance, cover plate
127 central opening, cover plate
128 portion, stator
130 shoulder, stator
132 radial surface, stator
134 lip, stator
136 radial surface, stator
138 radially inner surface, stator
140 circumferential groove
142 portion, stator
144 radially inner surface, stator
148 radial surface, cover plate
150 gap
152 standard long bolt
154 standard needle
156 surface, spring
158 distal end, long bolt
160 distal end, needle
162 opening, cover plate
164 inside distance, cover plate
166 outside diameter, portion 128
168 radially inwardly extending protrusion, stator
170 radially outwardly extending protrusion, rotor
172 chamber

The invention claimed is:

1. A camshaft phaser, comprising:
a stator:
arranged to receive rotational torque, and configured to rotate around an axis of rotation;
including a surface facing radially outwardly; and,
defining a recess;
a rotor configured to rotate with respect to the stator and arranged to be non-rotatably connected to a camshaft;
a spiral spring disposed in the recess and including:
a first spring end non-rotatably connected to the rotor; and,
a second spring end non-rotatably connected to the stator; and,
a resilient cover plate:
including an inner surface defining a central opening through which the axis of rotation passes, the inner surface directly connected to the surface of the stator facing radially outwardly;
enclosing the spiral spring in the recess; and,
circumferentially preloaded.

2. The camshaft phaser of claim 1, wherein
the stator blocks displacement of the resilient cover plate in at least one axial direction parallel to the axis of rotation of the camshaft phaser.

3. The camshaft phaser of claim 1, wherein the inner surface of the resilient cover plate is in compressive contact with the surface facing radially outwardly.

4. The camshaft phaser of claim 1, wherein:
the resilient cover plate includes:
a first plate end facing in a first circumferential direction; and,
a second plate end facing the first plate end in a second circumferential direction, opposite the first circumferential direction; and,
the first plate end and the second plate end define a gap in the first circumferential direction.

5. The camshaft phaser of claim 4, wherein
the first plate end and the second plate end are displaced away from each other so as to increase the gap when removing the resilient cover plate from the stator.

6. The camshaft phaser of claim 4, wherein the preloading of the resilient cover plate urges the first plate end and the second plate end toward each other.

7. The camshaft phaser of claim 1, wherein the resilient cover plate is discontinuous in a circumferential direction.

8. The camshaft phaser of claim 1, wherein:
the stator further includes a surface facing radially inwardly; and,
the resilient cover plate includes a radially outer surface free of contact with the surface facing radially inwardly.

9. The camshaft phaser of claim 1, wherein at least a portion of the resilient cover plate does not overlap the stator in a radially outer direction.

10. The camshaft phaser of claim 1, wherein:
the stator defines a groove extending in a circumferential direction; and,
the resilient cover plate is disposed in the groove.

11. The camshaft phaser of claim 10, wherein:
the groove is defined by the surface facing radially outwardly;
the resilient cover plate includes a radially innermost portion;
the radially innermost portion includes the inner surface; and
the radially innermost portion is disposed in the groove.

12. The camshaft phaser of claim 10, wherein:
the groove is bounded by a lip in an axial direction of the camshaft phaser; and, the lip blocks displacement of the resilient cover plate in the axial direction.

13. The camshaft phaser of claim 10, wherein the resilient cover plate is axially fixed within the groove.

14. The camshaft phaser of claim 1, wherein the stator extends past the resilient cover plate in a axial direction of the camshaft phaser.

15. The camshaft phaser of claim 1, wherein the spiral spring is located between the stator and the resilient cover plate in n axial direction of the camshaft phaser.

16. The camshaft phaser of claim 1, wherein:

the stator further includes a plurality of radially inwardly extending protrusions;

the rotor includes a plurality of radially outwardly extending protrusions circumferentially interleaved with the plurality of radially inwardly extending protrusions; and, the plurality of radially inwardly extending protrusions and the plurality of radially outwardly extending protrusions at least partially defining a plurality of chambers.

17. A camshaft phaser, comprising:

a stator arranged to receive rotational torque, configured to rotate around an axis of rotation, and defining a recess and a groove;

a rotor arranged to be non-rotatably connected to a camshaft and configured to rotate with respect to the stator;

a spiral spring disposed in the recess; and, a resilient cover plate:

including an inner surface defining a central opening through which the axis of rotation passes, the inner surface disposed in the groove;

enclosing the spiral spring in the recess; and, compressively engaging the stator in a radially inward direction.

18. The camshaft phaser of claim 17, wherein:

the resilient cover plate further includes:

a first end facing in a first circumferential direction; and, a second end facing the first end in a second circumferential direction, opposite the first circumferential direction; and, the first end and the second end define a gap in the first circumferential direction.

19. The camshaft phaser of claim 17, wherein:

the stator includes a surface facing radially outwardly and defining the groove extending in a circumferential direction; and, the resilient cover plate includes a radially innermost portion disposed in the groove.

20. A camshaft phaser, comprising:

a stator arranged to receive rotational torque, configured to rotate around an axis of rotation, and defining a recess and a groove;

a rotor arranged to be non-rotatably connected to a camshaft and configured to rotate with respect to the stator;

a spiral spring disposed in the recess and including:

a first spring end non-rotatably connected to the rotor; and, a second spring end non-rotatably connected to the stator; and, a resilient cover plate including:

a radially innermost surface defining a central opening through which the axis of rotation passes, the radially innermost surface disposed in the groove;

a first plate end facing in a first circumferential direction; and, a second plate end facing the first plate end in a second circumferential direction, opposite the first circumferential direction, the first plate end and the second plate end bounding a gap in the first circumferential direction, wherein:

a spring force of the resilient cover plate urges:

the radially innermost surface into contact with the stator; and, the first plate end and the second plate end toward each other; and, the spiral spring is located between the stator and the resilient cover plate.

* * * * *